US005388495A

United States Patent [19]

Atsumi

[11] Patent Number: 5,388,495

[45] Date of Patent: Feb. 14, 1995

[54] UPPER CYMBAL FASTENING ASSEMBLY FOR A HI-HAT CYMBAL

[75] Inventor: Shizuo Atsumi, Shizuoka, Japan

[73] Assignee: Yamaha Corporation, Shizuoka, Japan

[21] Appl. No.: 251,737

[22] Filed: May 31, 1994

[30] Foreign Application Priority Data

Jun. 2, 1993 [JP] Japan ..... 5-154616

[51] Int. Cl.[6] ..... G10D 13/02

[52] U.S. Cl. ..... 84/422.3

[58] Field of Search ..... 84/422.3; 248/125

[56] References Cited

U.S. PATENT DOCUMENTS

| | | | |
|---|---|---|---|
| 4,111,095 | 9/1978 | Simons | 84/422.3 |
| 4,458,574 | 7/1984 | Hoshino | 84/422.3 |
| 4,526,083 | 7/1985 | Lemert | 84/421 |
| 4,928,567 | 5/1990 | Kurosaki | 84/422.3 |

FOREIGN PATENT DOCUMENTS

| | | |
|---|---|---|
| 57-8059 | 2/1982 | Japan . |
| 62-30065 | 8/1987 | Japan . |

*Primary Examiner*—Howard B. Blankenship
*Assistant Examiner*—Patrick J. Stanzione
*Attorney, Agent, or Firm*—Ostrolenk, Faber, Gerb & Soffen

[57] ABSTRACT

In construction of an upper cymbal fastening assembly in which a felt washer unit holding an upper cymbal is clamped between an upper lock nut unit and a lower clutch nut unit both arranged on a tubular holder inserted over an extension rod, the clutch nut unit is made up of a pair of locally joined sections one of which is elastically deformable toward the other when a vertical force is applied thereto. The elastic deformation brings said pair of sections into firm pressure contact with the tubular holder thereby preventing slacking of the clutch nut unit due to vibrations during performance of the hi-hat cymbal.

4 Claims, 4 Drawing Sheets

UPPER CYMBAL FASTENING ASSEMBLY FOR A HI-HAT CYMBAL

BACKGROUND OF THE INVENTION

The present invention relates to an upper cymbal fastening assembly for a hi-hat cymbal, and more particularly relates to improvement in a system for fastening an upper cymbal to an associated extension rod on a hi-hat cymbal.

The main parts of a hi-hat cymbal are mounted on a tripod made up of 3 foldable legs. More particularly, the tripod supports an upright lower pipe and an upper pipe is telescopically coupled to the lower pipe by assistance of an wing screw which is used for level adjustment. An extension rod extends slidably through the lower and upper pipes with it exposed lower end being operationally connected to a foot pedal attached to the tripod. A return spring is accommodated in a spring casing arranged in parallel to the lower pipe in order to urge the foot pedal to return to its stand-by position when foot pressure is removed. Upper and lower cymbals are attached to the upper section of the extension rod exposed upwards from the upper pipe by assistance of respective fastening assemblies.

When the foot pedal is pressed downwards against repulsion of the above-described return spring, the upper cymbal crashes against the lower cymbal for sound generation. As foot pressure is removed, the foot pedal resumes its stand-by position to separate the upper cymbal from the lower cymbal.

Furious vibrations are generated on a hi-hat cymbal during performance because of high pitch, repeated crash of both cymbals. So, the cymbals must be firmly attached in position to the associated extension rod without any undesirable displacement. In particular the fastener assembly for the upper cymbal which undergoes frequent, vertical reciprocation during performance, it required to fasten upper cymbal reliably to the extension rod whilst well withstanding furious vibrations.

Examples of such a fastener assembly are disclosed in Japanese Utility Model Publications Sho. 57-8059 and Sho. 62-30065.

In the construction of JUMP Sho. 57-8059, a threaded pipe provided with an outer thread is idly inserted over the upper section of an extension rod and a tubular holder is attached atop the threaded pipe whilst embracing the extension rod. A fastener bolt is screwed into a radial threaded hole formed in the tubular holder with its inner point in pressure contact with the extension rod. At a position bellow the tubular holder, a felt washer unit is inserted over the threaded pipe. The felt washer unit is made up of a pair of felt pieces which sandwich an upper cymbal between them. At a position between the tubular holder and the felt washer unit, a lock nut unit is screwed over the threaded pipe. The lock nut unit is made up of upper and lower nut pieces. Just below the felt washer unit, a clutch nut unit is screwed over the lower section of the threaded pipe. Thus, the felt washer unit is clamped between the lock nut unit and the clutch nut unit. In the region of the felt washer unit, a wide circumferential groove is formed in the threaded pipe for reception of the upper cymbal. The depth of this circumferential groove is designed same as or larger than that of the outer thread on the threaded pipe so that movement of the upper cymbal should not damage the outer thread on the threaded pipe. Except for the lower joint to the threaded pipe, the inner diameter of the tubular holder is designed larger than that of the threaded pipe. This design enables the fastener bolt to firmly fasten the extension rod so that the latter should not displace out of the correct position despite unavoidable vibrations generated during performance.

The construction proposed in JUMP Sho. 62-30065 is an improvement of this earlier proposal. In the case of this improvement, a clutch bolt is attached to the upper section of a threaded pipe as a substitute for the tubular holder used in the earlier proposal and a fastener bolt is screwed into a radial threaded hole in the clutch bolt. On the side opposite to the threaded hole, a cutout is formed in the clutch bolt in communication with the threaded hole. The fastener bolt presses an extension rod against upper and lower edge in the cutout. Thus, the extension rod is fastened at three points for higher stability.

In either case, the clutch nut unit clamping the felt washer unit is coupled to the threaded pipe via simple screw engagement. Such a screw engagement can hardly withstand furious vibrations generated during performance and tends to allow slacking in clamp by the clutch nut unit, thereby inducing undesirable displacement of the upper cymbal held by the felt washer unit.

SUMMARY OF THE INVENTION

It is thus the basic object of the present invention to prevent undesirable displacement of an upper cymbal on a hi-hat cymbal which is caused by furious vibrations generated during performance.

In accordance with the present invention, a radial, through cutout is formed in the outer surface of a clutch nut unit to be screwed over a threaded pipe inserted over an extension rod; vertical, threaded holes are formed through upper and lower sections of the clutch nut unit bordering the cutout in axial alignment with each other; and a fastener bolt is screwed into the threaded holes.

DETAILED DESCRIPTION OF THE PREFERRED EMBODIMENTS

Figure 1:
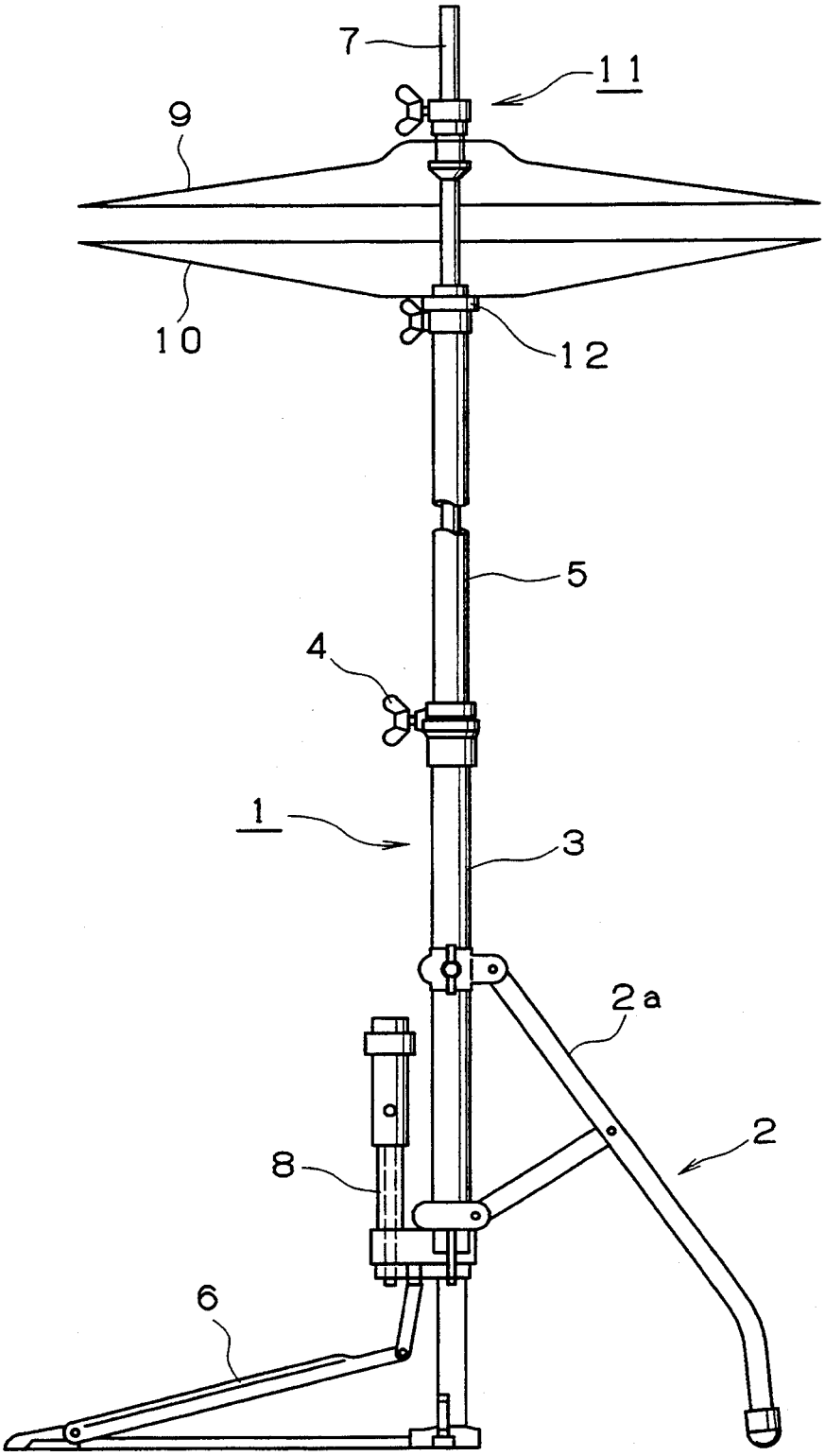
FIG. 1 is a side view of an entire hi-hat cymbal to which the present invention is applied.

One example of the hi-hat cymbal incorporating the fastening assembly of the present invention is shown in FIG. 1, in which the main parts of the hi-hat cymbal 1 are mounted on a tripod 2 made up of 3 foldable legs 2*a*. The tripod 2 supports an upright lower pipe 3 and an upper pipe 5 is telescopically coupled to the lower pipe 3 by assistance of a wing screw 4 which is used for level adjustment of the hi-hat cymbal. An extension rod 7 extends slidably through the lower and upper pipes 3, 5 with its exposed lower end being operationally connected to a foot pedal 6 attached to the tripod 2. A return spring not shown is accommodated in a spring casing 8 arranged in parallel to the lower pipe 3 in order to urge the foot pedal 6 to return to its standby position when foot pressure is removed. Upper and lower cymbals 9, 10 are attached to the upper section of the extension rod 7 exposed upwards from the upper pipe 5 by assistance of respective fastening assemblies.

Figure 2:
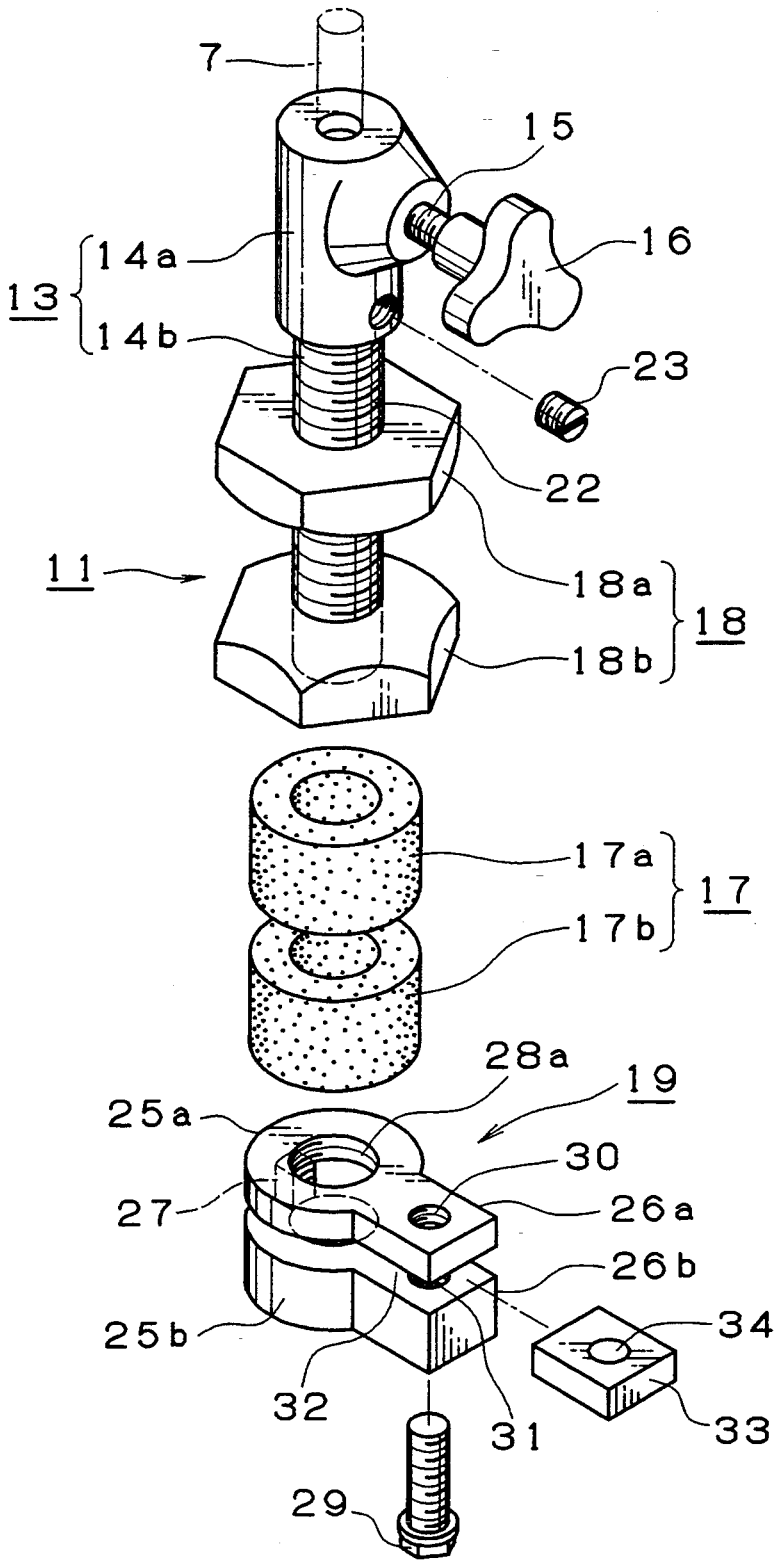
FIG. 2 is a perspective view of one embodiment of the upper cymbal fastening assembly in accordance with the present invention a disassembled state.
Figure 3:
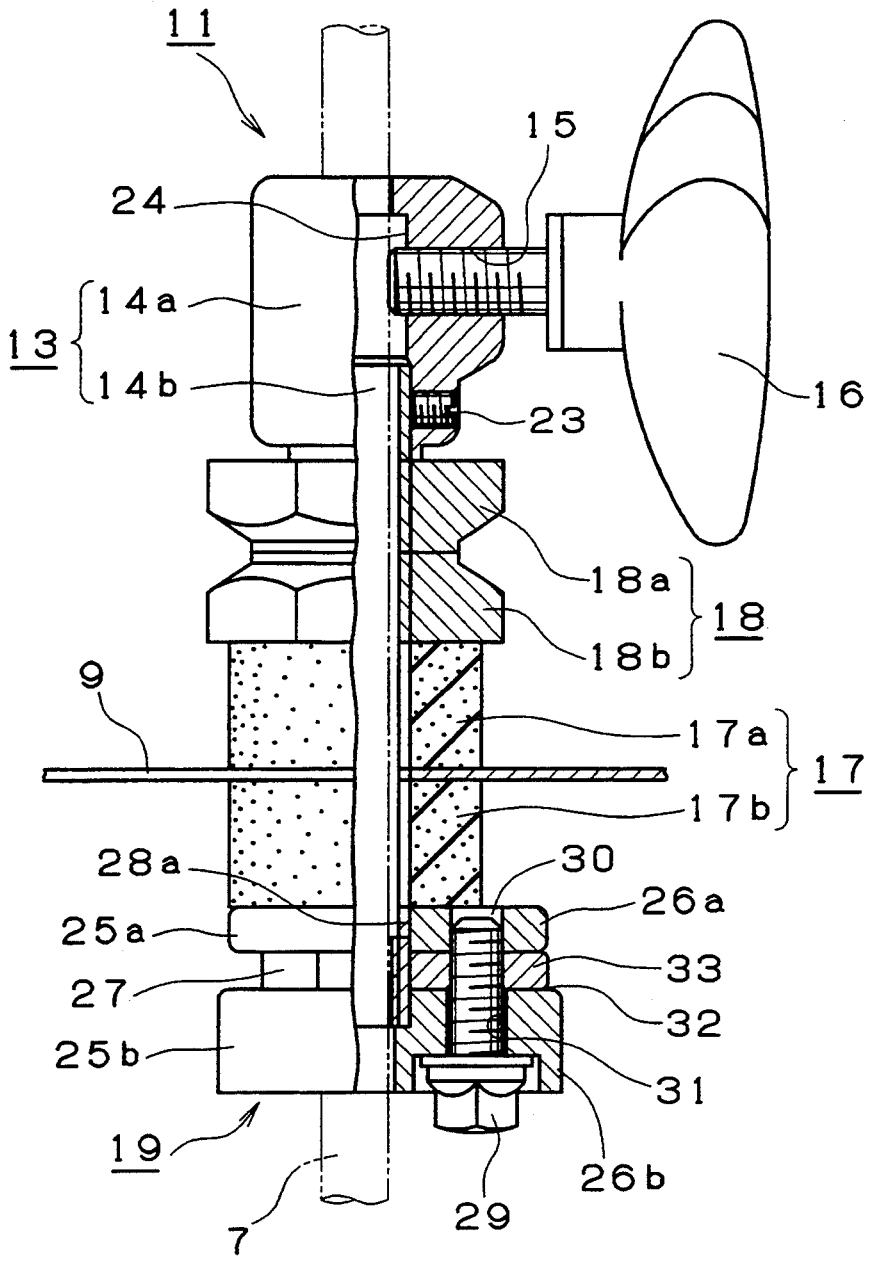
FIG. 3 is a side view, partly in section, of the upper cymbal fastening assembly shown in FIG. 2 in an assembled state.
Figure 4:
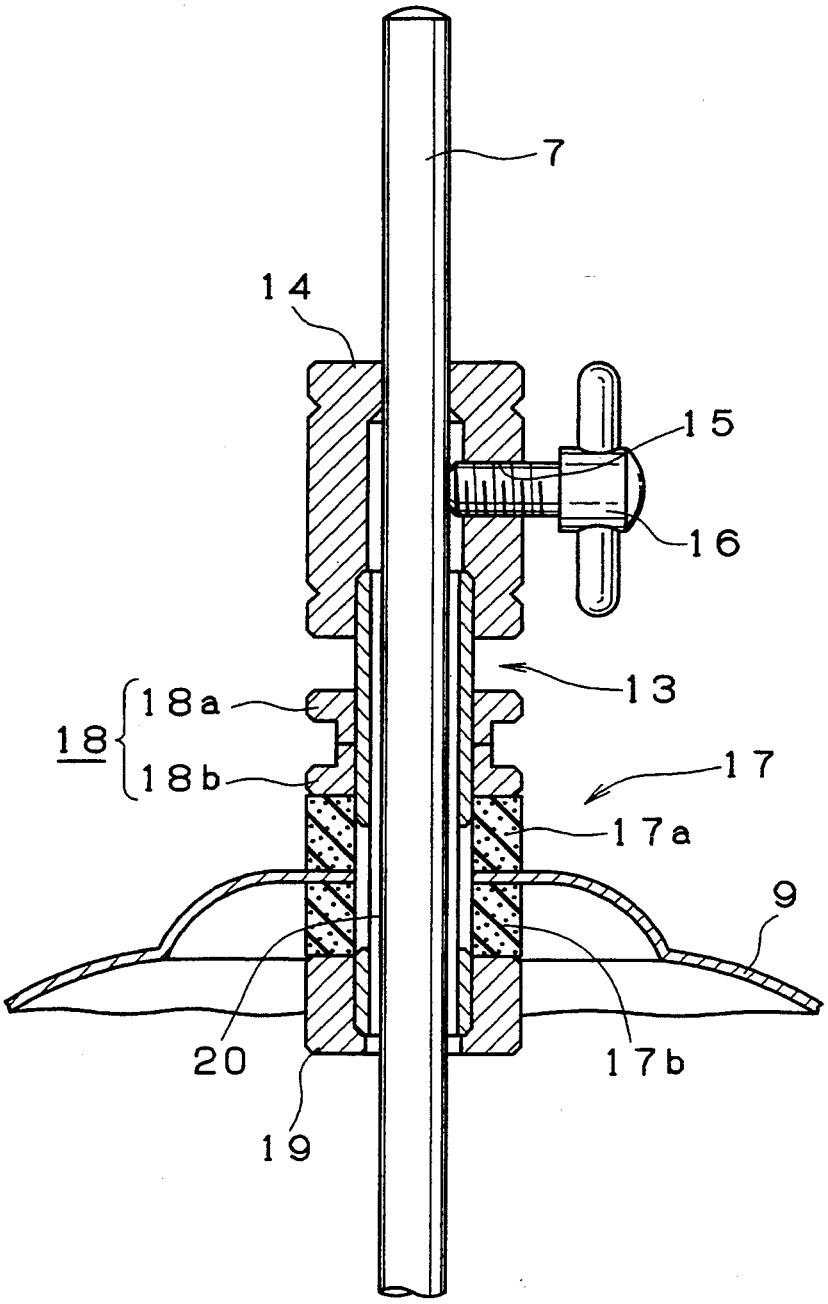
FIG. 4 is a side view, partly in section, of a typical, conventional upper cymbal fastening assembly.

One embodiment of the upper cymbal fastening assembly in accordance with the present invention is shown in FIGS. 2 and 3. The fastening assembly 11 includes a tubular holder 14 to be inserted over the extension rod 7. The tubular holder 14 is made up of an upper main body **14*a* and a lower threaded extension 14*b* provided with an outer thread 22. The main body 14*a* is secured atop the threaded extension 14*b* by assistance of a set screw 23. A threaded hole 15 is formed radially through the main body 14*a* in communication with a center bore 24 of the latter so that a fastener bolt 16 is screwed into the threaded hole 15 in order to firmly fasten the extension rod 7**.

The inner diameter of the upper section of the center bore 24 is designed equal to or somewhat larger than the outer diameter of the extension rod 7. The lower section of the center bore 24 is threaded for screw engagement with the lower threaded extension **14*b*. The inner diameter of the intermediate section of the center bore 24 is designed sufficiently larger than the outer diameter of the extension rod 7**.

A felt washer unit 17 is inserted over the threaded extension **14*b* of the tubular holder 14. The felt washer unit 17 is made up of a pair of felt pieces 17*a* and 17*b* which sandwich the upper cymbal 9. At a position above the felt washer unit 17, a lock nut unit 18 is made up of upper and lower nut pieces 18*a*, 18*b* screwed over the threaded extension 14*b* of the tubular holder 14. Likewise, a clutch nut unit 19 is screwed over the threaded extension 14*b* at a position below the felt washer unit 17. As a result, the felt washer unit 17 is clamped between the upper lock nut unit 18 and the lower clutch nut unit 19**.

The main body **14*a* and the threaded extension of the tubular holder 14** may be formed in one body with each other.

The clutch nut unit 19 is made up of upper and lower sections locally connected to each other. More specifically, the upper section includes a ring-shaped upper nut piece **25*a* and an upper radial projection 26*a*. Whereas, the lower section includes a ring-shaped lower nut piece 25*b* and a lower radial projection 26*b*. The upper and lower nut pieces 25*a*, 25*b* are preferably similar in configuration. Likewise, the upper and lower radial projections 26*a*, 26*b* are preferably similar in configuration. The upper and lower sections are connected to each other by a joint 27 formed between the nut pieces 25*a* and 25*b***.

The nut pieces **25*a* and 25*b* ar provided with threaded center bores 28*a* and 28*b*, respectively, for screw engagement with the threaded extension 14*b* of the tubular holder 14. The joint 27 and the radial projections 26*a*, 26*b* are located at opposite positions with respect to the center bores 28*a*, 28*b*. The joint 27 is preferably threaded in the inner face for screw engagement with the threaded extension 14*b* of the tubular holder 14**.

The upper section of the clutch nut unit 19 is uniform in thickness over its entire area but smaller in thickness than the lower section. As a consequence, the upper section is elastically deformable in the vertical direction about the joint 27 between the upper and lower sections.

The radial projection **26*a* of the upper section is provided with a vertical threaded hole 30 and the radial projection 26*b* of the lower section is provided with a like threaded hole 31 in axial alignment with the threaded hole 30. These threaded holes 30, 31 are adapted for screw engagement with a common fastener bolt 29. Thus, a cutout, i.e. a gap 32 is left between the upper and lower radial projections 26*a*, 26*b* which is receptive of an elastic spacer 33. The spacer 33 is provided with a through hole 34 for free passage of the fastener bolt 29. The elastic spacer 33 is optionally used to prevent excessive fastening by the fastener bolt 29**.

In operation, the fastener bolt 29 is in screw engagement with the threaded holes 30, 31 of the radial projections **26*a*, 26*b* past the through hole 34 in the elastic spacer 33. The upper section, i.e. the nut piece 25*a* and the radial projection 26*a*, deforms elastically about the joint 27 towards the lower section, i.e. the nut piece 25*b* and the radial projection 26*b*. As a result, the center bores 28*a* and 28*b* of the clutch nut unit 29 are brought into firm pressure contact with the threaded extension 14*b* of the tubular holder 14. Friction force generated by this pressure contact well prevents accidental slacking in clamp by the clutch nut unit 19, i.e. undesirable displacement of the upper cymbal 9** during performance of the hi-hat cymbal.

The configuration of the clutch nut unit 19 is not limited to the foregoing example. For example, the lower section may be designed thinner than the upper section. It is only required that one of the two sections is elastically deformable about the joint towards the other section.

I claim:

1. An upper cymbal fastening assembly for a hi-hat cymbal comprising an elongated tubular holder inserted over an extension rod and made up of an upper main body and a lower threaded extension, a felt washer unit inserted over said threaded extension of said tubular holder in order to clamp an upper cymbal, a lock nut unit screwed over said threaded extension of said tubular holder at a position above said felt washer unit, a clutch nut unit screwed over said threaded extension of said tubular holder at a position below said felt washer unit in order to clamp said felt washer unit in cooperation with said lock nut unit, said clutch nut unit being made up of upper and lower sections coupled to each other via a local joint whilst leaving a horizontal gap, and one of said two sections being constructed elastically deformable about said local joint towards the other of said two sections when a vertical force is applied thereto.

2. An upper cymbal fastening assembly as claimed in claim 1 in which said one section is configurated thinner than said the other section.

3. An upper cymbal fastening assembly as claimed in claim 1 in which said vertical force is generated by a fastener bolt in screw engagement with said two sections.

4. An upper cymbal fastening assembly as claimed in claim 1 further comprising an elastic spacer inserted into said horizontal gap.

* * * * *